United States Patent [19]

Otto et al.

[11] Patent Number: 5,076,127

[45] Date of Patent: Dec. 31, 1991

[54] REVOLVING CUTTING PRESS WITH A ROTATABLE TOOL

[75] Inventors: Gerhard Otto; Volker Gellrich, both of Alfeld; Werner Teichert, Hanover, all of Fed. Rep. of Germany

[73] Assignee: C. Behrens AG, Fed. Rep. of Germany

[21] Appl. No.: 508,903

[22] Filed: Apr. 12, 1990

[30] Foreign Application Priority Data

May 12, 1989 [DE] Fed. Rep. of Germany ..... 3915489

[51] Int. Cl.[5] ..... B26F 1/14

[52] U.S. Cl. ..... 83/552; 83/549

[58] Field of Search ..... 83/549, 552, 550

[56] References Cited

U.S. PATENT DOCUMENTS

| | | | |
|---|---|---|---|
| 4,412,469 | 11/1983 | Hirata et al. | 83/552 |
| 4,532,845 | 8/1985 | Jinnouchi | 83/552 |
| 4,658,688 | 4/1977 | Shah et al. | 83/552 |

*Primary Examiner*—Timothy V. Eley

*Attorney, Agent, or Firm*—Michael J. Striker

[57] ABSTRACT

A revolving cutting press comprises at least one revolving plate having a peripheral region provided with a plurality of complete tool sets, a drive for rotating the revolving plate about an axis, at least one tool set rotatable about an axis extending substantially perpendicularly to plane of the revolving plate, the tool sets being connectable with the drive of the revolving plate.

18 Claims, 6 Drawing Sheets

REVOLVING CUTTING PRESS WITH A ROTATABLE TOOL

BACKGROUND OF THE INVENTION

The present invention relates to a revolving cutting press with a rotatable tool. More particularly, it relates to a revolving cutting press which has at least one revolving plate provided in its peripheral region with a plurality of complete tool sets, a drive for driving the revolving plate about an axis, and at least one tool set rotatable about an axis extending substantially perpendicular to the plane of the revolving plate.

Revolving cutting presses of the above mentioned general type are known in the art. During the production of punched parts by means of revolving cutting presses, tools profiled in the peripheral region are frequently used. They are received in the revolving plate rotatably about their longitudinal axes and are controllable in their angular position. Such revolving cutting press is disclosed for example in the German Document DE 3,441,530 A1. It is characteristic for this revolving cutting press that for driving the tools about their longitudinal axes at least a special motor drive is required. Such a drive is arranged in the peripheral region of the revolving plate and can be coupled with individual tool sets. For transferring a predetermined tool set to its working position which includes a rotation of the revolving plate to the respective punching position and a rotation of the tool set about its longitudinal axis to a predetermined angular position, the revolving plate is first transferred by actuation of its drive to the punching position and fixed with special arresting devices. Then, the drive associated with the rotation of the tool about its longitudinal axis is coupled with a respective tool, and the tool is transferred to the desired angular position. For specific positioning of the tools relative to their longitudinal axes, in other words for specific angular adjustment of the tools, the tool sets prior to a plate rotation must be either arrested in their last rotary angular position so that, starting from a predetermined, supplied rotary angular position the rotation required for reaching a new rotary angular position is achieved. Or, before each change of the rotary angular position, first the exact zero position of the respective tool set must be adjusted to arrive at a new angular position from this zero position.

These known revolving cutting presses are relatively complicated with respect to their drive and control expenses for the system of the revolving plates and rotatable tools. Moreover, depending on the coupling of the special drive associated with rotation of the tool sets about their longitudinal axes, the synchronization of the rotary angular positions of upper and lower tool for avoiding the angular errors and tool damages must be thoroughly monitored. Furthermore, the coupling of a further drive in many cases causes additional inaccuracies.

SUMMARY OF THE INVENTION

Accordingly, it is an object of the present invention to provide a revolving cutting press of the above mentioned type, which avoids the disadvantages of the prior art.

More particularly, it is an object of the present invention to provide a revolving cutting press of the above mentioned general type which is structurally simplified in the sense of its drive and control.

In keeping with these objects and with others which will become apparent hereinafter, one feature of the present invention resides, briefly stated, in a revolving cutting press in which the tool set rotatable about its axis is connectable with the drive of the revolving plate.

In accordance with the present invention, the rotary movement required for driving a tool set about its longitudinal axis is derived directly from an available controllable drive system for driving the revolving plate about its rotary axis. This presumes however features for selective coupling of the above mentioned drive either with the revolving plate or with a predetermined tool set. In comparison with the above described prior art, the arrangement of a special drive whose only purpose is to rotate an individual tool set is dispensed with. Moreover, an available controllable drive is used for rotation of the tool set. This results in a reduction of the structural and controlling expenses. While in the above discussed known revolving cutting press the drive for rotating individual tool sets about their longitudinal axes is located in the peripheral region of the revolving press and therefore a certain increase of the lateral place consumption occurs, the inventive cutting press provides the further advantage in that its dimensions are not touched due to individual tool sets rotatable about their longitudinal axes. The reason is that the drive elements which serve for the coupleable connection with the plate drive are arranged in a region near the axis of the revolving plate.

In accordance with another embodiment of the present invention, each revolving plate can be provided with an individual drive from which the rotary movement of individual tool sets can be derived. However, also a common drive for both revolving plates arranged over one another can be provided, so that the rotary movements of all tool sets can be derived from this common drive. In the latter case, a branching transmission for transmitting the rotary movements to both revolving plates is required. But, as compared with the first mentioned case, the arrangement of special synchronizing devices for insuring the identical rotary movement of both revolving plates can be dispensed with. In this case, angular errors with respect to the position of the upper and lower tool are avoided in a simple manner. Since the functional elements required for transmission of rotary movement to the individual tool sets are arranged on the opposite side of the revolving plates, the narrow intermediate space between the revolving plates is not affected by the rotary drive of individual tool sets.

Still another feature of the present invention is that the switchable functional elements are arranged in the region immediately adjacent to the axis of the revolving plate. As a result, a compact construction of the rotary drive for the tool sets which does not affect the outer space is provided.

Residual functional elements of the drive can include a disc coaxially surrounding the axis of the revolving plate for frictional torque transmission, and a controllable device for the axial displacement of the disc. This controllable device can be of any construction. It is especially advantageous when it is designed as a pressure-medium actuated device. The remaining functional elements for actuation of the tool drive can include a toothed gear transmission providing a kinematic connection between a rotation a plate drive shaft and the individual tool. When a frictional connection is produced by the above mentioned disc, the whole revolving plate including the tool sets rotatable on it moves as a rigid body. When a frictional connection through the above mentioned disc is however not produced and the respective revolving plate is arrested, a rotation of the plate drive shaft results in a rotation of the tool set in correspondence with the transmission ratio of the above mentioned toothed gear transmission. Since all rotatable tool sets are coupled in this sense with the plate drive shaft, an individual tool set always rotates all tool sets during a positioning movement.

The invention provides for an especially simple embodiment of the controllable device for axial displacement of the disc. It includes a ring piston received in a ring groove in the revolving plate, and pressure medium openings in the plate drive shaft. When the disc is axially displaced on the plate drive shaft for the frictional torque transmission and at the same time does not rotate relative to the latter, the above mentioned ring piston causes the rotary movement of the plate drive shaft only in the event of the pressure application, or in other words, in case when a torque transmission to the revolving plate occurs.

The controllable device can be designed in accordance with an alternative embodiment, wherein the ring piston can be formed of one piece integrally with the above mentioned disc. In this construction a reduction of the number of structural elements is achieved and therefore a simple construction of the revolving plate is provided. Simultaneously, the mass of the parts rotatable with the plate drive shaft during its rotation is increased by the mass of the ring piston.

All drive elements of an individual tool set are always arranged on the upper or lower side of the respective revolving plate, so that the narrow intermediate space between the revolving plates is not affected by the rotatable arrangement of the individual tool sets. The upper tool can be composed from a punch and a punch holder which latter can be received in an axially displaceable and non-rotatable manner in an opening of a bush inserted in the upper revolving plate. The bush can be driveable through a toothing formed in its edge. However, the bush can be formed of one piece integrally with the punch holder, so that here also the number of the structural elements is reduced.

Tooth gaps can be eliminated in the region of the toothed gear transmission for driving the tool sets and thereby the accuracy of the rotary angular adjustment of each tool set can be increased. This can be achieved by displaceable arrangement of the toothed gears on the respective revolving plates. These features as well as the adjustable arrangement of the toothing of the bushes serve for accurate adjusting of a zero position for all rotatable tool sets. In connection with the substantially play-free toothed gear transmission, synchronization errors between the rotary angular positions of the upper and lower tool are avoided and simultaneously the control expenses for positioning of the tool sets maintained at a low level.

Depending on the space consumption for mounting the toothed gear transmission above or below a revolving plate, any number of tool sets can be driveable about their longitudinal axes. Also, the toothed gear transmission can be replaced by a respective rotary angular, switchable transmission device between the plate drive shaft on the one hand and the bush on the other hand.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
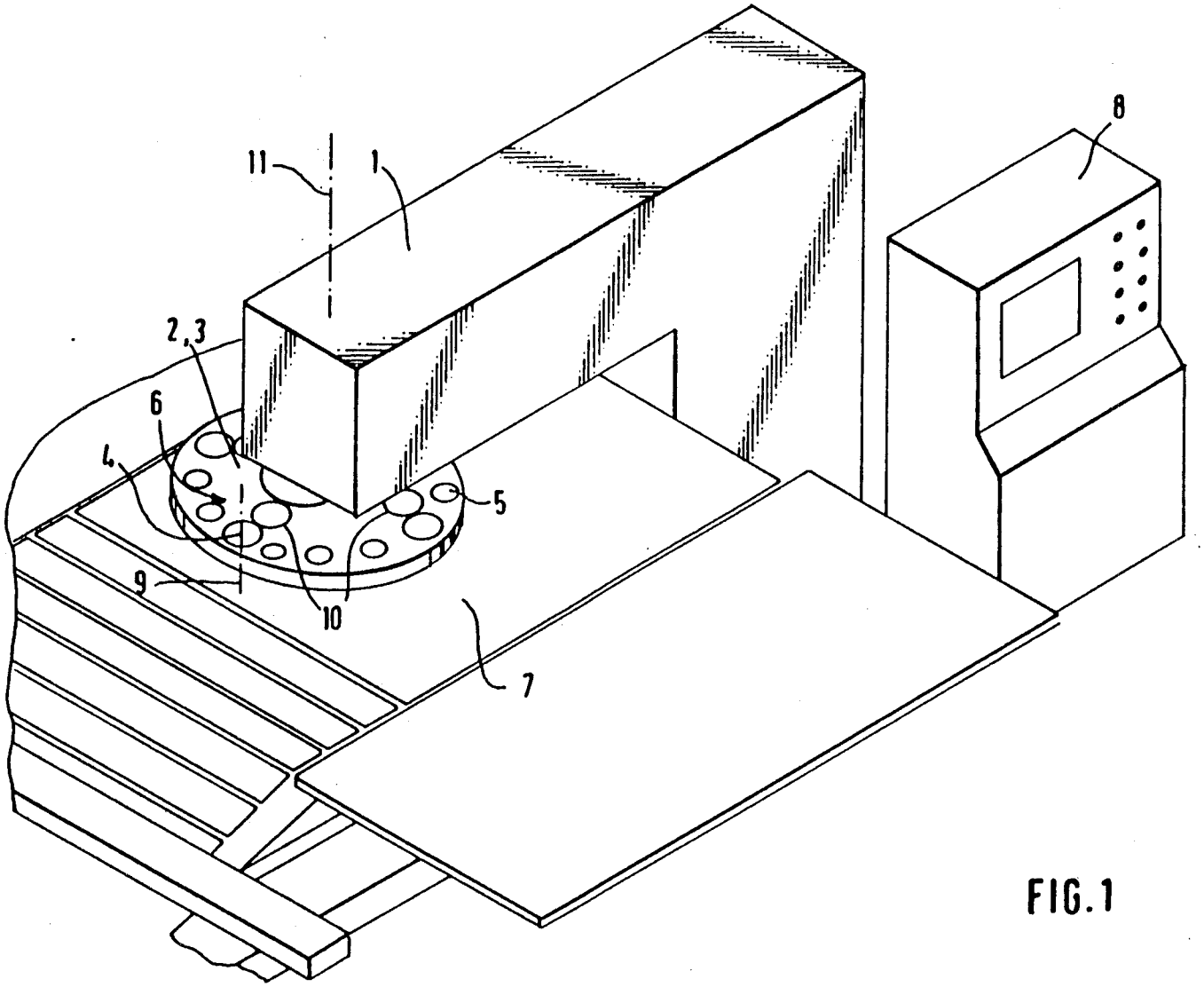
FIG. 1 is a perspective view of a revolving cutting press in accordance with the present invention.

FIG. 1 shows an inventive revolving cutting press as a whole. The revolving cutting press has a C-shaped base frame 1, and two revolving plates 2 and 3 arranged at a distance from one another on the end region of the base frame 1. The revolving plates 2 and 3 are coaxial with one another and rotatable about a vertically extending axis. The revolving plates 2 and 3 carry a plurality of complete tool sets 4, 5 arranged in series in the peripheral region of the revolving plates. The construction of the tool sets will be explained in detail later on, and the tool set includes at least one punch arranged in the upper revolving plate 2 together with a punch holder and a matrix arranged in the lower revolving plate. The two sets 4, 5 of the upper and lower revolving plates 2, 3 are located so that they are axially oriented relative to one another.

The base frame 1 serves also for receiving the support and the drive of the revolving plates, as well as elements for actuating the press drive, which cooperate respectively with the tool sets located in a working station 6. Reference numeral 7 identifies a known coordinate table. By a not shown auxiliary means, the coordinate table serves for exact positioning of the workpiece which as a rule is flat, for example a sheet, relative to the working station 6.

For turning or controlling the cutting press, a DNC-control 8 is provided. The DNC-control 8 is accommodated near the base frame in a switching cabinet.

The punches of at least some tool sets 4 are profiled in their peripheral region. These tool sets 4 are received rotatably about their respective longitudinal axes 9 in their receptacles in the revolving plates 2, 3. For this purpose the revolving plates are provided with special drive elements 10 which will be explained later on and serve for individual driving of the above mentioned tool sets about their longitudinal axes 9.

Reference numeral 11 schematically identifies an axis. The revolving plates 2, 3 are rotatable in the base frame 1 about the axis 11.

Figure 2:
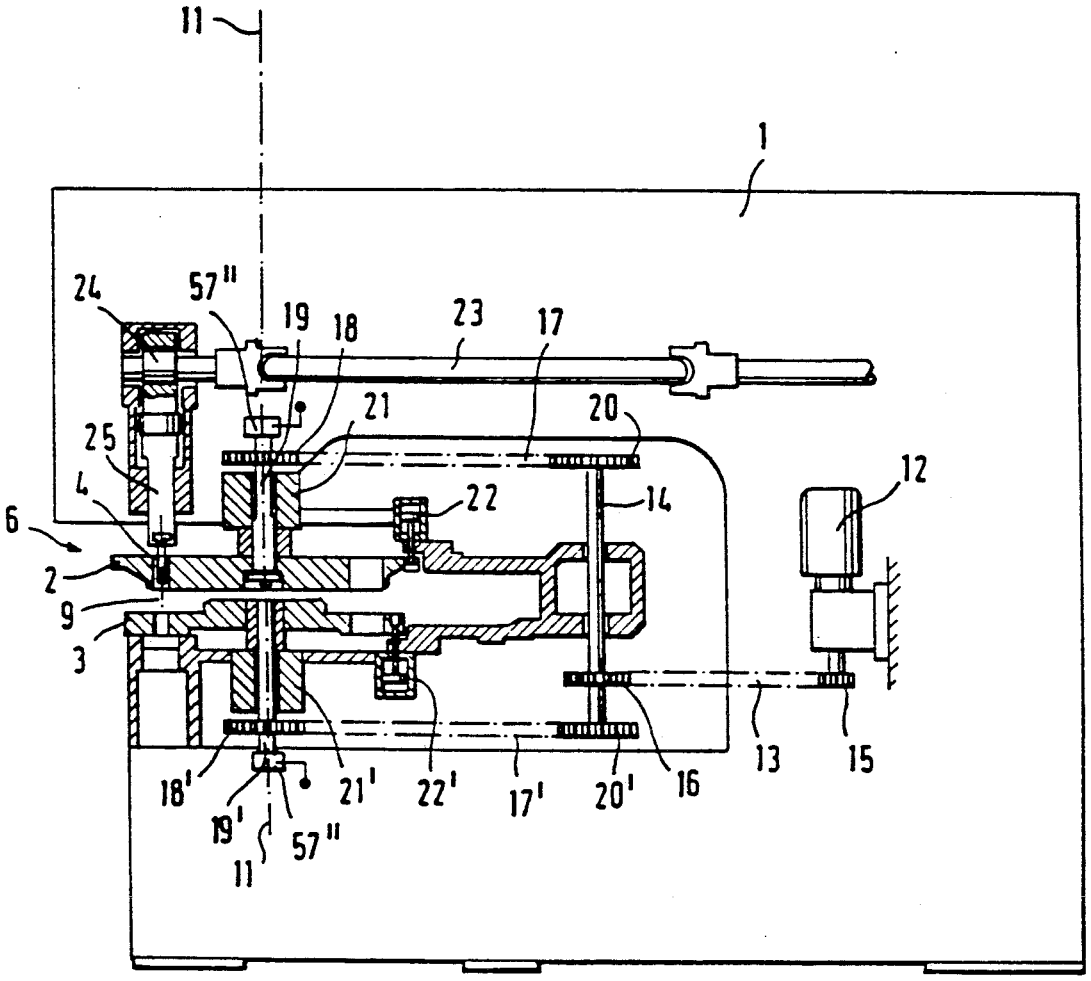
FIG. 2 is a side view of a revolving cutting press in accordance with the present invention.

An electric motor is identified with reference numeral 12 in FIG. 2. It serves for driving in a not shown manner both revolving plates 2, 3 about their axes 11 and the tool sets 4 about their axes 9. The motor 12 which is stationarily mounted in the base frame 1 is connected for this purpose with an intermediate shaft 14 through a toothed belt 13. The intermediate shaft 14 is supported in the base frame 1. The connection is performed through pulleys 15 and 16 which are arranged on the drive shaft of the motor 12 on the one hand and the intermediate shaft 14 on the other hand. The motor 12 is NC-controllable in a known manner and is in operative communication with the DNC-control 8 in a not shown manner.

The intermediate shaft 14 which is vertically supported in the base frame 1 is connected in turn with pulleys 18, 18' through toothed belts 17, 17'. The pulleys 18, 18' are arranged respectively on the plate rive shaft 19, 19' extending in the direction of the axes 11. The connection of the toothed belt 17, 17' with the intermediate shaft 14 is performed through pulleys 20, 20' arranged on the latter. The belt drive defined by the pulleys 19, 20 in connection with the belt drive 17 on the one hand, serve respectively for driving the upper plate 2 and the lower revolving plate 3 and moreover also for driving the individual tool sets 4 as will be explained hereinbelow.

The plate drive shafts19, 19' are received in bearings which have bearing housings 21, 21' supported in the base frame 1. For arresting of the revolving plates 2, 3 in predetermined rotary angular positions, arresting devices 22, 22' are provided as will be explained later on. A further motor which serves for driving the press itself is not shown in the drawings. It is in operative communication with the press plunger 25 through a cardan shaft 23 and an eccentric 24. The punch located in the working station 6 is coupled with the press plunger 25.

Figure 3:
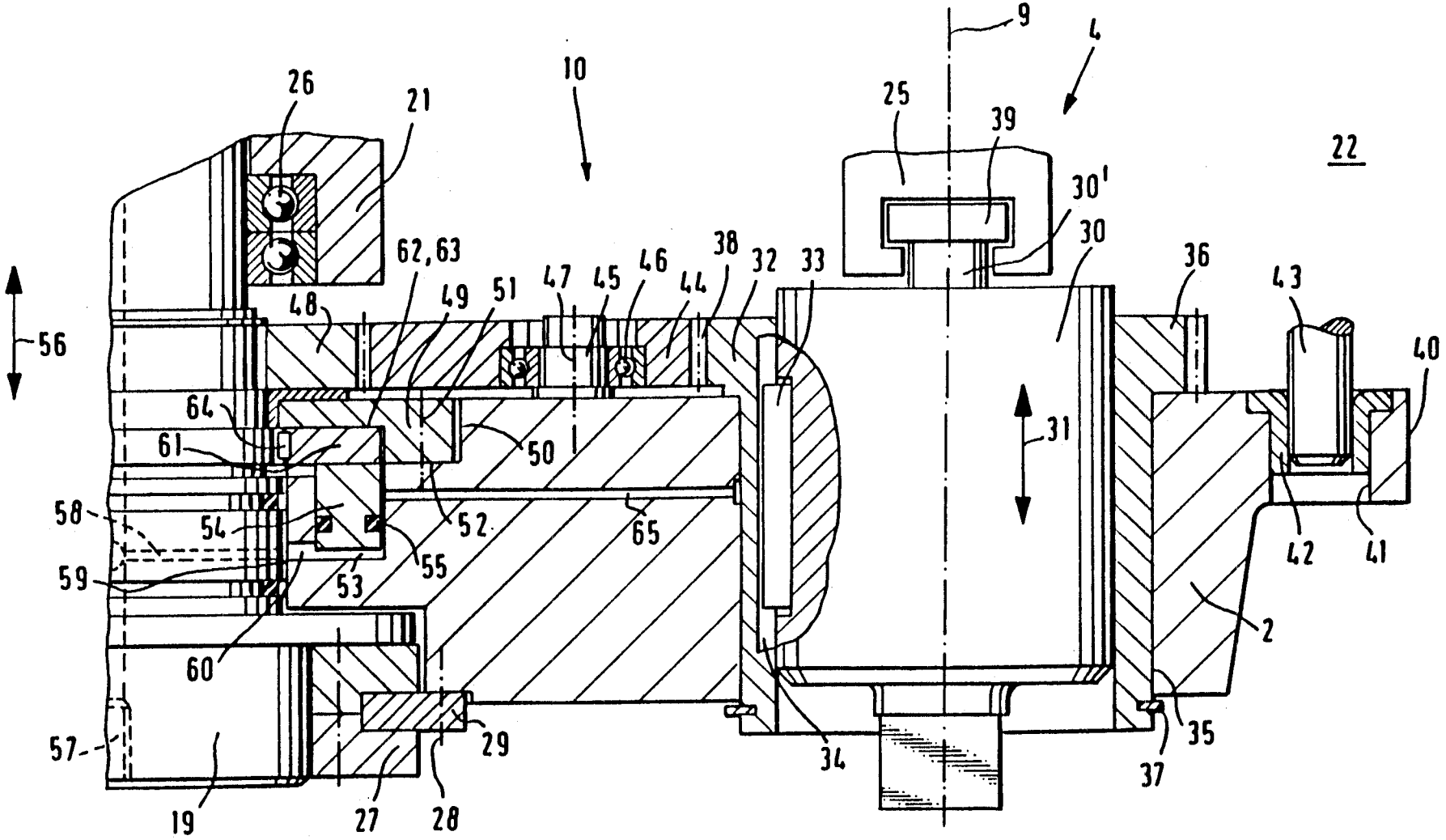
FIG. 3 is an axial section of an upper revolving plate of the revolving cutting press of the present invention.

FIG. 3 shows a construction of the upper revolving plate 2 in an axial section. The plate drive shaft 19 is supported on the one hand by a bearing housing 21 received in the base frame 1 or the radial bearing 26 associated with the bearing housing, and in a radial axial bearing 27 schematically shown in the drawings. The axial bearing 27 cooperates with a running ring 29 mounted on the lower side of the revolving plate 2 by screws 28.

The tool set 4 of the upper revolving plate 2 shown partially in section includes a punch holder 30 which contains a punch 30' and is non-rotatably supported in a bush 32. The punch 30' is displaceable in a known manner in direction of the arrow 31. A key 33 for non-rotatable guidance of the punch holder 30 is inserted in its periphery and slides inside a groove 34 formed on the inner side of the bush 32. The sliding is performed in a peripheral direction and in a substantially play-free manner. The bush 32 in turn is inserted in a corresponding opening 35 of the revolving plate 2. Inside the opening it is supported on the one hand by a ring body 36 arranged on its upper end for engaging the opening 35, and on the other hand by an arresting ring 37 engaging in the outer side of the bush part which extends outwardly beyond the lower side of the revolving plate 2. The ring body 36 carries a toothing 38 in its peripheral region. The toothing 38 serves for driving the tool set 4 in rotation about its axis 9 in a manner which will be explained hereinbelow.

The punch 30' is provided at its upper side with a T-shaped head part 39. This head part is received in a correspondingly designed receptacle of the press plunger 25.

A plurality of openings 41 are arranged in an outer edge 40 of the revolving plate in a uniform manner at positions corresponding to the positions of the tool sets. The opening 41 extends parallel to the axes 9 of the tool sets and accommodate receiving bushes 42. The receiving bushes 42 cooperate with arresting pins 43 of the stationary arresting device 22.

Reference 44 identifies a toothed gear which engages the toothing 38. The toothed gear 44 is further rotatably supported on a bearing bush 45 by a radial bearing 46. The bearing bush 45 is connected by a screw 47 with the revolving plate. The axis of the toothed gear 44 extends parallel to the axis of the plate drive shaft 19.

The above mentioned toothed gear 44 is in further engagement with a toothed gear 48. The latter is non-rotatably arranged on the plate drive shaft 19.

Reference 49 identifies an insertion ring which is inserted in an opening 50. The opening 50 is arranged in the vicinity of the axis of the revolving plate 2 and is open above and toward the axis of the plate. The insertion ring 49 is connected at its radially outer end with the revolving plate 2 by screws 51. The lower side 52 of the recess 50 is provided with a ring groove 53. The ring groove 53 extends in the vicinity of the axis and coaxially to the plate drive shaft 19 and open in direction to the insertion ring 49. A ring piston 54 is inserted in the groove 53. The ring piston 54 is provided with seals 55 at its radially inner and outer sides. It is slidable in the ring groove 53 in direction of the arrow 56.

An opening 57 which extends coaxially inside the plate drive shaft 19 serves for pressure medium supply to the ring piston 54. A plurality of radial openings 58 extend from the opening 57 and provide a communication between the opening 57 and a ring chamber 59. The ring chamber 59 is formed between the outer side of the plate drive shaft 19 on the one hand and the inner side of the revolving plate 2 on the other hand. The above mentioned ring chamber also communicates with the lower side of the ring groove 53 through a series of radially extending passages 60 for loading the ring piston 54.

Reference numeral 57'' shown in FIG. 2 identifies the rotary connections for the pressure medium supply.

Reference numeral 61 identifies a circular ring-shaped disc which is slidingly inserted in a recess 63 provided in the lower side 62 of the insertion ring 49. It extends coaxially to the axis of the plate drive shaft 19. The disc 61 is non-rotatably mounted on the plate drive shaft 19 by a multiple-connection 64 and is insignificantly axially slidable due to this connection.

It can be recognized from the above presented description that under the action of a pressure loading of the ring piston 54 through the openings 57, 58, 60 the ring piston 54 slides upwardly in direction of the arrow 56 and in this manner presses the disc 61 against the insertion ring 49 so that the revolving plate 2 is coupled with the plate drive shaft 19 in a frictional manner. Without the pressure loading, the disc 61 is freely rotatable relative to the insertion ring 49. Therefore, with the arrested revolving plate 2, a rotation of the plate drive shaft 19 in this case results through the toothed gears 48, 44 in a rotation of the bush 32.

Reference numeral 65 identifies a further radial opening inside the revolving plate 2. It connects the ring groove 53 with the inner side of the opening 65, so that leakage fluid produced inside the ring groove 53 is used for lubricating the bush 32.

Figure 4:
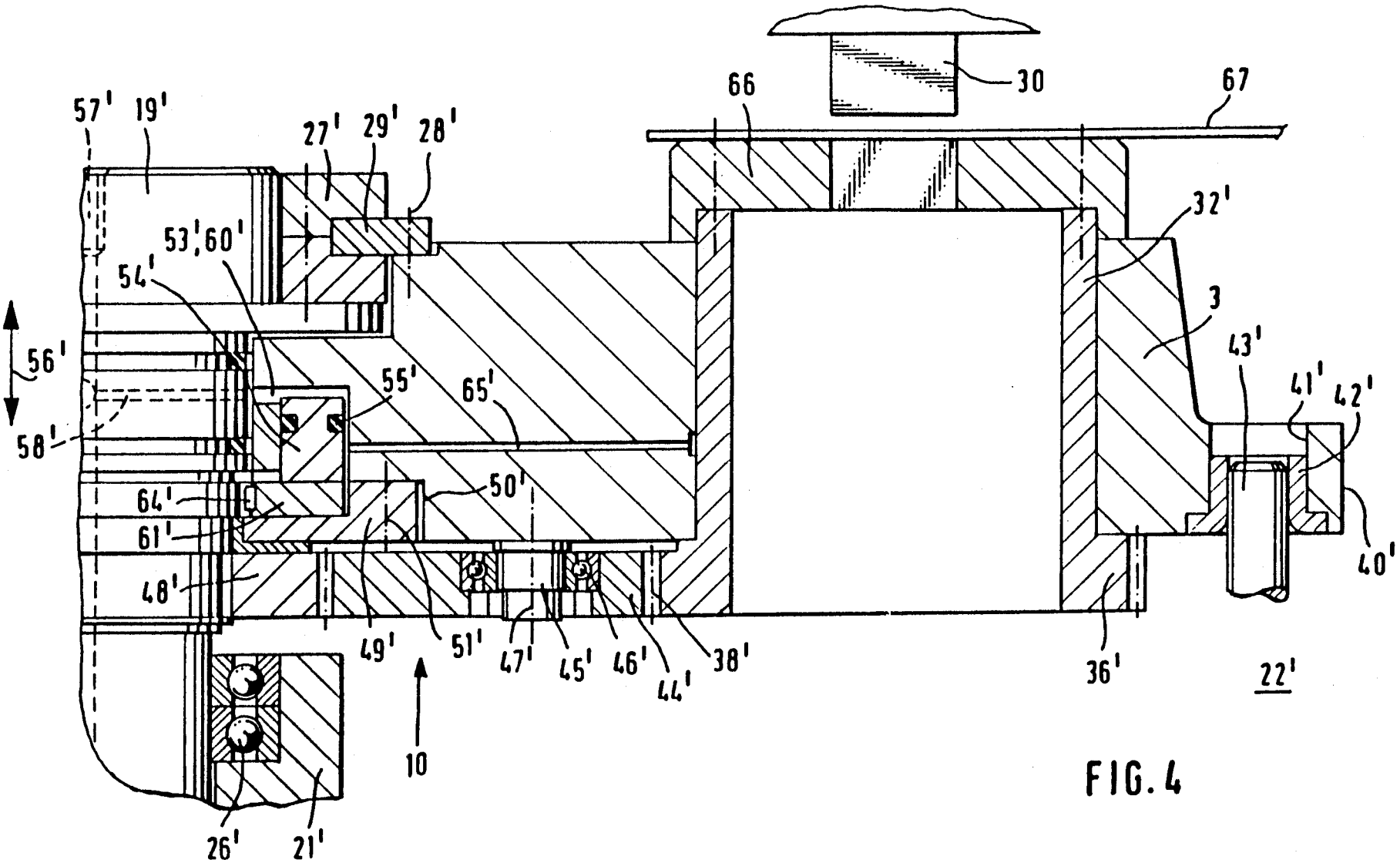
FIG. 4 is an axial section of a lower revolving plate of the revolving cutting press of the present invention.

FIG. 4 shows the lower revolving plate corresponding to the showing of FIG. 3. The comparable operational elements are identified with the same reference numerals with the addition of ', and therefore a redundant description is avoided.

Reference numeral 66 identifies a matrix arranged axially non-displaceably on the bush 32', and rotatable relative to the bush.

Reference numeral 67 identifies a workpiece to be machined and formed for example as a flat workpiece. In deviation from the upper revolving plate 2, the drive elements 10 for rotating the tool, here the matrix 66, are located on the lower side of the lower revolving plate. The arrangement is however mirror-symmetrical relative to the upper revolving plate. Therefore the recess 50' as well as the ring groove 54' are open to the lower side of the revolving plate 3. Since the operation of the selective coupling of the plate drive shaft 19' with the revolving plate 3 or the bush 32' and thereby the tool, here the matrix 66, corresponds to the respective mechanisms of the upper revolving plate 2 its description can be dispensed with.

Figure 5:
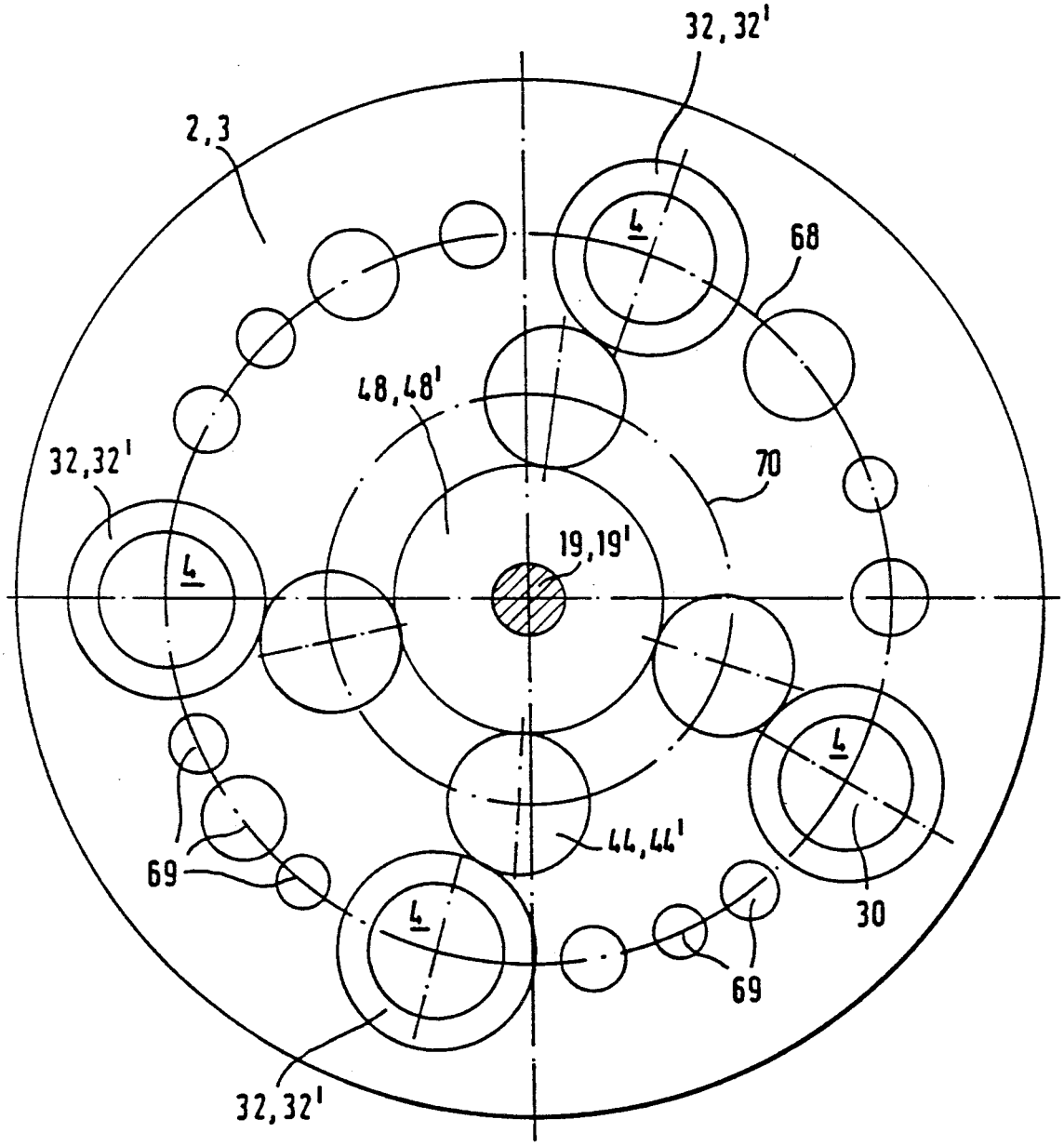
FIG. 5 is a plan view of the upper side of the upper revolving plate.

The showing of FIG. 5 which, depending on the properties of the respective tool, can be interpreted either as a plan view of the upper side of the upper revolving plate 2 or the view of the lower side of the lower revolving plate 3, shows that all tool sets are arranged in the peripheral region of the revolving plate on a common partial circle 68. In the shown embodiment four tool sets 4 are supported rotatably about their axes. The remaining tools which are different from one another and identified as a whole with reference numeral 69 are arranged non-rotatably about their respective longitudinal axes. The intermediately arranged toothed gears 44, 44' provided for connection between the central toothed gears 48, 48' are located in turn also on a common partial circle 70.

Figure 6:
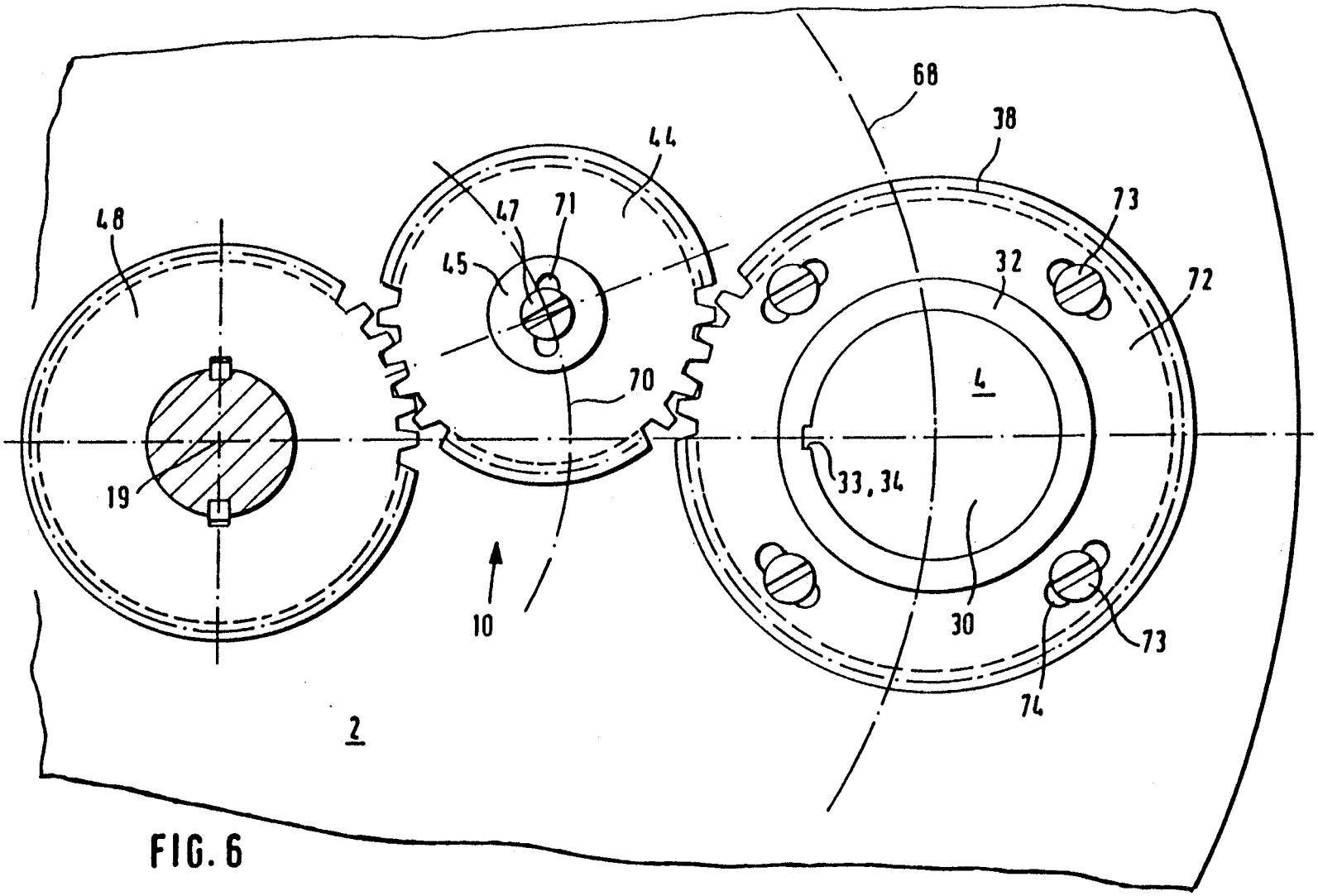
FIG. 6 is a plan view of details of the upper revolving plate of the inventive revolving cutting press.

FIG. 6 shows on a plan view the inventive drive elements 10 in accordance with a further embodiment on the upper revolving plate 2. In identical manner they can be used also on the lower revolving plate 3. The central toothed gear 48 is mounted through two keygroove connections on the plate drive shaft 19.

The bearing bush 45 is provided with a longitudinal opening 71 for receiving the screw 47. With a respective dimension of the longitudinal opening 71, a certain adjustability of the set position of the toothed gear 44 is possible. The toothing 38 is located in a toothed ring 72 which is screwed in a not shown circular ring support. The latter forms an integral part with the bush 32. The connection between the toothed ring 72 and the above mentioned circular ring support is performed by screws 73 inserted in longitudinal openings 74 of the toothed ring 72. The longitudinal openings 74 are located along a common partial circle and extend substantially coaxially to the axis of the tool set 4.

The adjustability of the central toothed gear 44 as well as the toothed ring 72 illustrated in FIG. 6 provides for an approximately play-free coupling of the rotary movement of the toothed gear 48 with the bush 32 on the one hand, and the adjustment of exactly definite initial angular position of the bush 32 on the other hand in such a manner that the central point of the keygroove connection 33, 34 is oriented to the central point of the plate drive shaft 19. In this manner, a highly accurate, play-free drive for the individual tool sets 4 is provided. Simultaneously, the control required for accurate positioning of a rotary angular position can be maintained low, since all tool sets are associated with the same zero position.

Practically, the arresting devices 22, 22' can be interconnected with the above mentioned ring pistons 54, 54' in a controllable manner, so that during pressure loading of the ring pistons the revolving plates are always freely rotatable.

It will be understood that each of the elements described above, or two or more together, may also find a useful application in other types of constructions differing from the types described above.

While the invention has been illustrated and described as embodied in a revolving cutting press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A revolving cutting press, comprising at least one revolving plate having a peripheral region provided with a plurality of complete tool sets; drive for rotating said revolving plate about an axis, at least one of said tool sets being rotatable about an axis extending substantially perpendicularly to a plane of said revolving plate, said tool sets being connectable with said drive of said revolving plate so that said drive is operative for rotation of both said revolving plate and said tool sets.

2. A revolving cutting press as defined in claim 1; and further comprising another revolving plate arranged coaxially relative to said first mentioned revolving plate, said revolving plates having sides facing away from one another; and further comprising functional elements arranged at said sides of said revolving plates for connecting said tool sets with said drive.

3. A revolving cutting press as defined in claim 2, wherein said drive includes a controllable motor and transmission connecting said motor with said revolving plates, said functional elements connecting said tool set with said motor.

4. A revolving cutting press as defined in claim 1; and further comprising another revolving plate coaxially arranged relative to said first mentioned plate, said drive including a drive unit provided for each of said revolving plates, said revolving plates having sides facing away from one another; and further comprising functional element for connecting said tool set with a respective one of said drives.

5. A revolving cutting press as defined in claim 1; and further comprising switchable functional elements for selective transmission of a rotary movement to one of said revolving plates and said tool set, said functional elements being arranged directly near said axis of said revolving plate.

6. A revolving cutting press, comprising at least one revolving plate having a peripheral region provided with a plurality of complete tool sets, another revolving plate coaxially arranged relative to said first mentioned plate; drive for rotating said revolving plate about an axis, said drive including a drive unit provided for each of said revolving plates, said revolving plates having sides facing away from one another; and functional elements for connecting said tool set with a respective one of said drives, each of said drives including a motor, said functional elements connecting said tool set with a respective one of said motors; at least one tool set rotatable about an axis extending substantially perpendicularly to a plane of said revolving plate, said tool sets being connectable with said drive of said revolving plate.

7. A revolving cutting press, comprising at least one revolving plate having a peripheral region provided with a plurality of complete tool sets, and another revolving plate arranged coaxially relative to said first-mentioned revolving plate; drive for rotating said revolving plate about an axis; at least one tool set rotatable about an axis extending substantially perpendicularly to a plane of said revolving plate, said tool sets being connectable with said drive of said revolving plate; switchable functional elements for selective transmission of a rotary movement to one of said revolving plates and said tool set, said functional elements being arranged directly near said axis of said revolving plate; a plate drive shaft, said functional elements including a non-rotatable disc provided for a frictional transmission of a torque from said plate drive shaft to said revolving plate, said disc being associated with said revolving plate, extending coaxially with said revolving plate and being displaceable relative to said revolving plate; and a controllable device for axial displacement of said disc.

8. A revolving cutting press as defined in claim 7, wherein said functional elements also include a toothed gear arranged on said revolving plate for connecting said tool set with said drive of said revolving plate, another toothed gear rotatable with said plate drive shaft and engaging with said first mentioned toothed gear, and a toothing provided on said tool set and engageable with said first mentioned toothed gear.

9. A revolving cutting press as defined in claim 8, wherein said first mentioned toothed gear is arranged on said revolving plate in a displaceable manner for elimination of tooth gaps.

10. A revolving cutting press as defined in claim 8, wherein said revolving plates includes plate and a lower revolving plate; a first rotatable bush having an edge extending beyond an upper plane of said upper revolving plate and a second rotatable bush having an edge extending beyond a lower plane of said lower revolving plate, said tool set having an upper tool and a lower tool each provided with said toothing, said toothing of said upper tool being formed in said edge of said first rotatable bush, while said toothing of said lower tool is formed in said edge of said second rotatable bush.

11. A revolving cutting press as defined in claim 10, wherein said upper tool includes a punch holder non-rotatably inserted in said first bush, while said lower tool includes a matrix carried by said second bush.

12. A revolving cutting press as defined in claim 11, wherein said first bush is formed of one piece integrally with said punch holder.

13. A revolving cutting press as defined in claim 10, wherein said toothings are formed by toothed rings which are angularly adjustable relative to said bushes.

14. A revolving cutting press as defined in claim 13, and further comprising first longitudinal openings; bearing bushes supporting said first mentioned toothed gears and mounted by said first longitudinal openings; and further longitudinal openings by which said toothed rings are mounted on said bushes and which extend in a peripheral region.

15. A revolving cutting press as defined in claim 7, wherein said controllable device for axial displacement of said disc includes an axially guided ring piston arranged in said revolving plate and provided with a pressure medium.

16. A revolving cutting press as defined in claim 15, wherein said revolving plate has a ring groove coaxial with said disc and axially guiding said ring piston.

17. A revolving cutting press as defined in claim 15, wherein said plate drive shaft has an axial opening and a plurality of radially extending openings through which the pressure medium is supplied to said ring piston.

18. A revolving cutting press as defined in claim 15, wherein said ring piston is formed of one piece integrally with said disc.

* * * * *